US006213665B1

(12) United States Patent
Degoix et al.

(10) Patent No.: US 6,213,665 B1
(45) **Date of Patent: *Apr. 10, 2001**

(54) MESS FREE DOSING AND DISPENSING DEVICES

(75) Inventors: Christophe Nicolas Degoix, Brussels (BE); Terence Graham Curtis, High Wycombe (GB)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/294,125

(22) Filed: Apr. 19, 1999

(51) Int. Cl.[7] ..... A47L 13/26

(52) U.S. Cl. ..... 401/209; 401/6; 401/119; 401/126; 401/136; 68/17 R

(58) Field of Search ..... 401/118, 119, 401/123, 126, 130, 136, 208, 209, 6; 68/17 R

(56) References Cited

U.S. PATENT DOCUMENTS

| | | | | |
|---|---|---|---|---|
| H1050 | * | 5/1992 | Petrillo | 401/6 |
| 5,011,316 | * | 4/1991 | Damon | 401/6 |
| 5,388,298 | * | 2/1995 | Rutter et al. | 8/158 |

* cited by examiner

*Primary Examiner*—Gregory L. Huson
*Assistant Examiner*—Peter deVore
(74) *Attorney, Agent, or Firm*—C. Brant Cook; Kim William Zerby; Steven W. Miller

(57) ABSTRACT

A hand held dosing and dispensing device for the pretreatment of fabrics is provided. The dosing and dispensing device has a hollow container for storing a liquid. The hollow container has at least one container wall and an inlet. The inlet includes an opening and an inlet wall which extends into the hollow container from the container wall of the hollow container. The inlet wall substantially encircles the opening of the inlet to prevent liquid discharge through the inlet during pretreatment of a fabric. A discharge is attached to the hollow container for dispensing the liquid therethrough for the pretreatment of fabrics. In addition, the opening can include a plurality of flexible and resilient tabs extending radially toward the center of the opening. The tabs are adapted to engage at least a portion of a bottle to secure the dosing and dispensing device to the bottle.

25 Claims, 7 Drawing Sheets

MESS FREE DOSING AND DISPENSING DEVICES

TECHNICAL FIELD OF THE INVENTION

The present invention relates to the field of dosing and dispensing devices, and, more particularly, to field of hand held dosing and dispensing devices which can be used for the pretreatment of fabrics.

BACKGROUND OF THE INVENTION

Dosing and dispensing devices are known in the art. These devices are sometimes used for the pretreatment of fabrics, wherein the device is used to dispense a liquid detergent onto a fabric for pretreatment of a stain and then the device and fabric are placed into a washing machine where the device doses the remaining liquid into the wash water during the wash cycle. Some such devices are provided in the form of a hand held hollow container for storing the liquid detergent having an applicator ball in fluid communication with the hollow container, as described, for example, in U.S. Pat. No. 5,887,753. While these devices function well for their intended purpose, there can sometimes be spillage of the liquid detergent from the hollow container-when the dispensing device is moved back and forth, side to side, and/or in a circular motion during the pretreatment of fabrics. This spillage is sometimes considered undesirable by a user, and, as such, there exists a need to provide improved dosing and dispensing devices which reduce liquid spillage during pretreatment of fabrics.

In addition, it is often times desirable to provide a mechanism for attaching these dosing devices to a bottle for convenient storage. One such mechanism for attachment is described in EP 0649934A1, wherein a dosing and dispensing device attaches adjacent the neck of bottle for storage. However, a liquid product which is sold globally is often sold in bottles of varying size based upon geographic region. For instance, 1.5 liter bottles are presently popular in Europe while 80 oz bottles are popular in North America. As such, there exists a need for improved structures for attaching dosing and dispensing devices to a bottle such that the device can be attached a plurality of bottle sizes, thereby providing a more universal dosing and dispensing device. Still further, there exists a need to provide dosing and dispensing devices which can both reduce liquid spillage during the pretreatment of fabrics and which can be attached to a plurality of bottle sizes.

SUMMARY OF THE INVENTION

A hand held dosing and dispensing device for the pretreatment of fabrics is provided. The dosing and dispensing device has a hollow container for storing a liquid. The hollow container has at least one container wall and an inlet. The inlet includes an opening and an inlet wall which extends into the hollow container from the container wall of the hollow container. The inlet wall substantially encircles the opening of the inlet to prevent liquid discharge through the inlet during pretreatment of a fabric. A discharge is attached to the hollow container for dispensing the liquid therethrough for the pretreatment of fabrics. In addition, the opening can include a plurality of flexible and resilient tabs extending radially toward the center of the opening. The tabs are adapted to engage at least a portion of a bottle to secure the dosing and dispensing device to the bottle.

Still further, a liquid treating system for fabrics is provided which includes a bottle for storing a liquid detergent and a dosing and dispensing device which is releasably attached to the bottle. The dosing and dispensing device can be provided in the same form as previously discussed and preferably engages a neck of the bottle for storage.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

Figure 1:
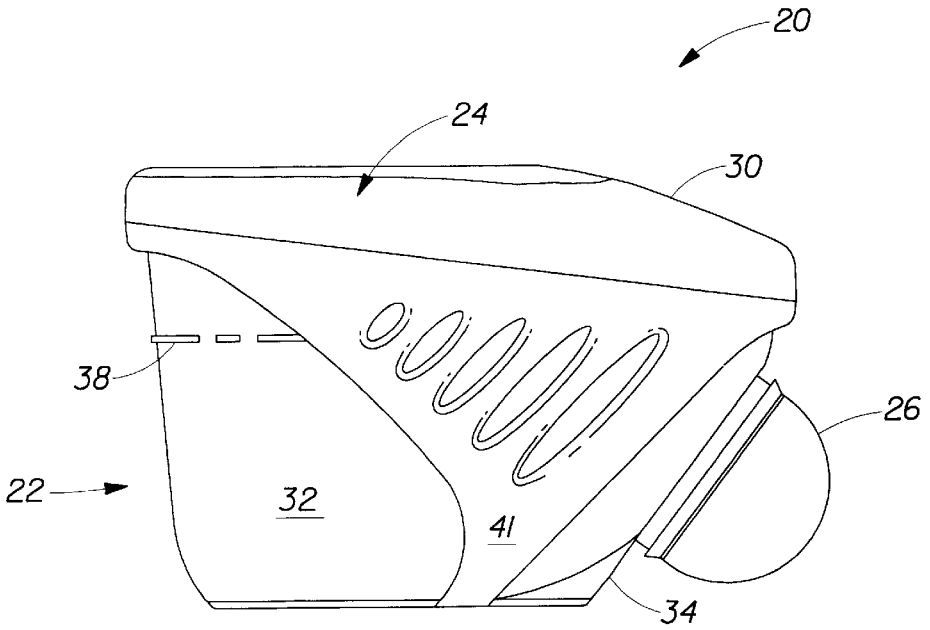
FIG. 1 is an elevational side view of a preferred dosing and dispensing device made in accordance with the present invention.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements. As discussed more fully hereafter, the present invention is directed to a dosing and dispensing device suitable for use with a washing machine. More preferably, the present invention is directed to a hand held dosing and dispensing device which can be used for the pretreatment of fabrics in a substantially mess free manner. As used herein, the phrase "pretreatment of fabrics" and its derivatives is intended to refer to a process whereby a user of the dosing and dispensing device applies a liquid, such as a liquid detergent, to a fabric by manipulating the device prior to placement of the device in the washing machine. As used herein, the term "manipulating" is intended to refer to hand manipulation of the dosing and dispensing device by any movement, including squeezing, side-to-side movement, back-and-forth movement, circular movement, and any combinations thereof. In addition, the present invention is directed to a dosing and dispensing device which can be attached to bottles of varying size.

Figure 2:
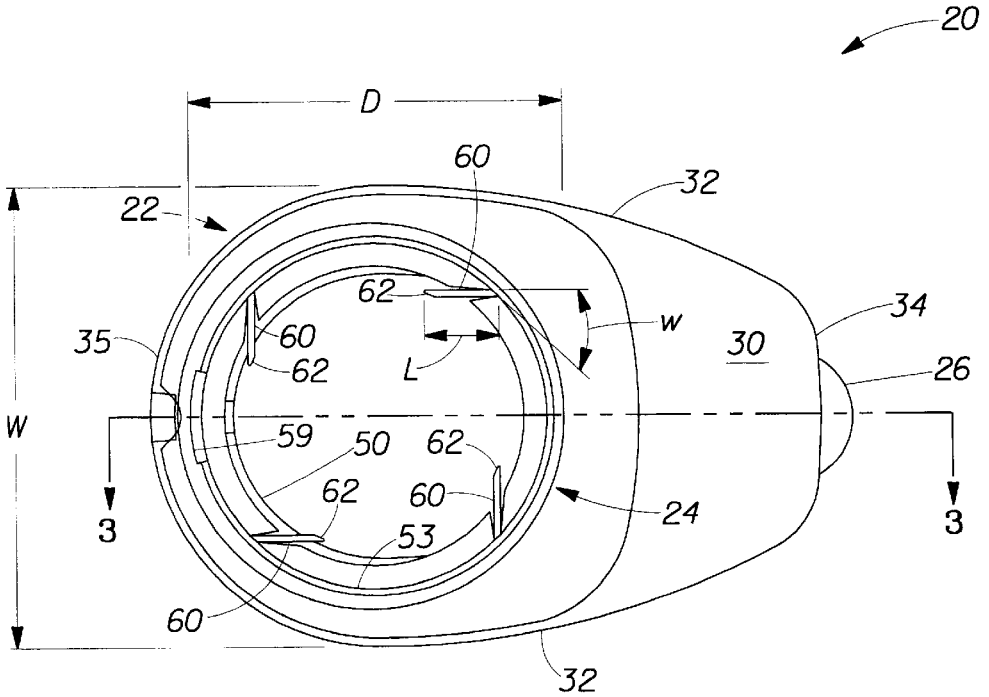
FIG. 2 is a top view of the dosing and dispensing device of FIG. 1.

FIGS. 1 to 5 illustrate an exemplary dosing and dispensing device 20 made in accordance with the present invention. Referring to FIGS. 1 and 2, The device 20 comprises a hollow container 22 having an inlet 24 for receiving a liquid and a discharge structure for discharging the liquid directly onto a fabric 25 (FIG. 5) for pretreatment of the fabric 25 prior to washing. The liquid remaining in the device 20 after pretreatment of the fabrics is preferably discharged through the inlet 24 when the device 20 is placed in the wash liquid of the washing machine during the wash cycle. The discharge structure 26 is in fluid communication with the hollow container 22 and can be provided in a variety of forms. For example, the discharge structure can be provided in the form of a roll on applicator or rollerball 26, such as one described in copending and commonly assigned U.S. patent application Ser. Nos. 08/732,363 and 08/836,633, these applications hereby being incorporated fully herein by reference. A preferred rollerball 28 is illustrated for purposes of discussion in the Figs. Another example of a discharge structure might include a brush or brush-like structure.

The hollow container includes container walls 30, 32, 34, 35 and 36 and, in particular, a top wall 30, side walls 32, front wall 34, rear wall 35 and bottom wall 36. The inlet 24 is disposed in the top wall 30 and the discharge structure 26 is located at the front wall 34. The container 22 can be provided with one or more fill lines about one at least one of the side walls 32, the front wall 34 or the rear wall 35. The fill lines visually indicate the preferred liquid levels within the container 22. More preferably, the container 22 has an upper fill line 38 which indicates the top level to which the container 22 should be filled with a pretreatment liquid 39. These liquid levels are preferably selected to provide the appropriate amount of dosing of the pretreatment liquid into the wash liquid of the washing machine depending upon the size of the wash load. While the container 22 is illustrated as having a front wall, side walls and rear wall which are curvilinear in shape, it will be appreciated that the container 22 can be provided in other shapes and sizes without departing from the scope of the present invention. For example, the container 22 can be provided with a plurality of side walls which are more or less curvilinear in shape than illustrated. Or a curvilinear wall which has no creases, folds or edges such that it is essentially a continuous wall. The container 22 can be formed from a plastic, and, more preferably, from a thermoplastic or a thermoset plastic suitable for use with a blow molding or injection molding process. Some plastics which can be used include polypropylene, polyethylene, polyurethane or polyvinyl chloride. More preferably, the device 20 is formed using a bi-injection molding process, wherein two materials are used during the injection molding process for distinct portions of the device 20. For instance, the top wall 30, side walls 32, front wall 34, rear wall 35 and bottom wall 36 can be formed from a rigid structural polypropylene while a grip structure 41 disposed about a portion of the side walls 32 and the bottom wall 36 can be formed from thermoplastic elastomer, such as Bergaflex from Theodor Bergmann Kunststoffwerk GmbH, Adolf-Dambach-Straebe 2-4, D-76571 Gaggenau Germany. The thermoplastic elastomer used to form the grip structure 41 preferably provides a soft, non-slip surface for gripping the device 20 during use while the structural polymer used to form the walls provides the structural rigidity for the device 20. In addition, the portions of the grip structure 41 disposed adjacent the bottom wall 36 provide a non-slip surface when the device is placed on a flat surface, such as the top of a washing machine or the like. In addition, the soft grip structure 41 can reduce the noise generated by the device 20 during use in a washing machine.

Figure 3:
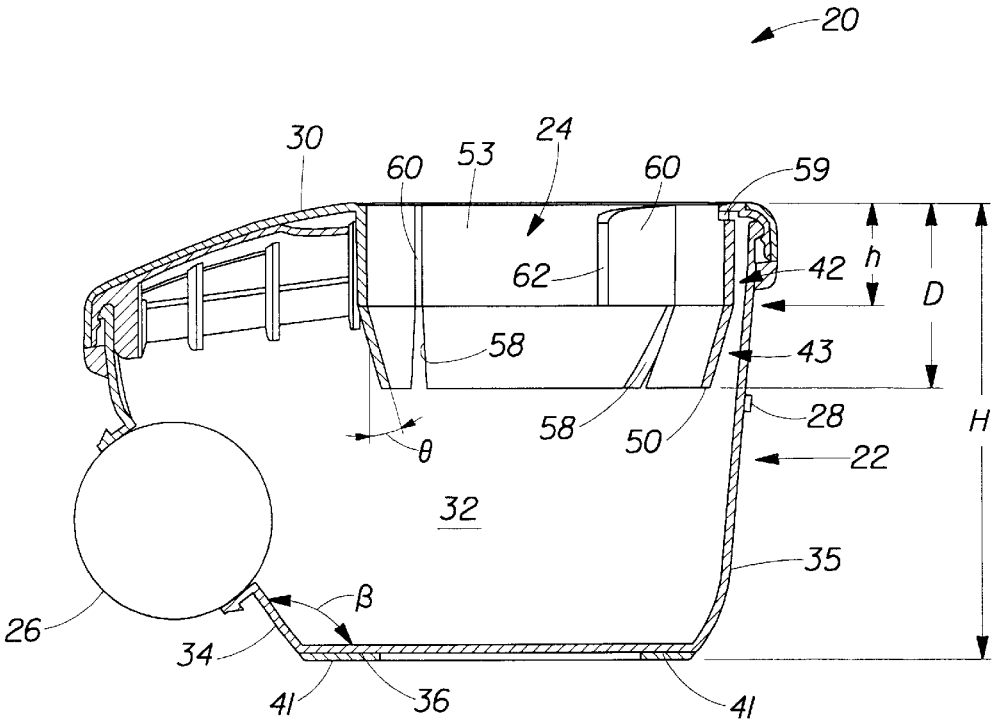
FIG. 3 is a cross sectional side view of the dosing and dispensing device of FIG. 2, taken along line 3—3 thereof.

In accordance with one aspect of the present invention, the inlet 24 is configured to limit liquid discharge therefrom during the pretreatment process. As previously discussed, Ad the manipulation of device 20 during the pretreatment process can cause movement of the liquid about the inside of the container 22. The inlet 24 is configured to prevent (i.e., limit or reduce) the discharge of the pretreatment liquid, thereby providing a substantially mess free device which enhances the pretreatment process for a user of the device. In general, the inlet 24 is disposed distal from the front wall 34 and adjacent the rear wall 35. The inlet 24 comprises an inlet wall downwardly depending from the top wall 30 which extends into the hollow container 22. More preferably, the inlet wall substantially encircles the opening of the inlet 24, and, most preferably, the inlet wall is provided in the from of a funnel having a top portion 42 and a bottom portion 43, as best seen in FIG. 3. While the opening of the inlet 24 is shown as generally circular in shape, the opening can be provided in other shapes, such as elliptical, parabolic and combinations thereof. The top portion 42 of the inlet 24 is generally cylindrical in shape and extends into the hollow container 22 from the top wall 30. The cylindrical shape and inside diametrical size of the upper portion 42 of the inlet 22 is preferably sufficient to accommodate therethrough the necks and/or caps of various sized bottles when the device 20 is attached to a bottle for storage, as discussed more fully hereafter.

Figure 4:
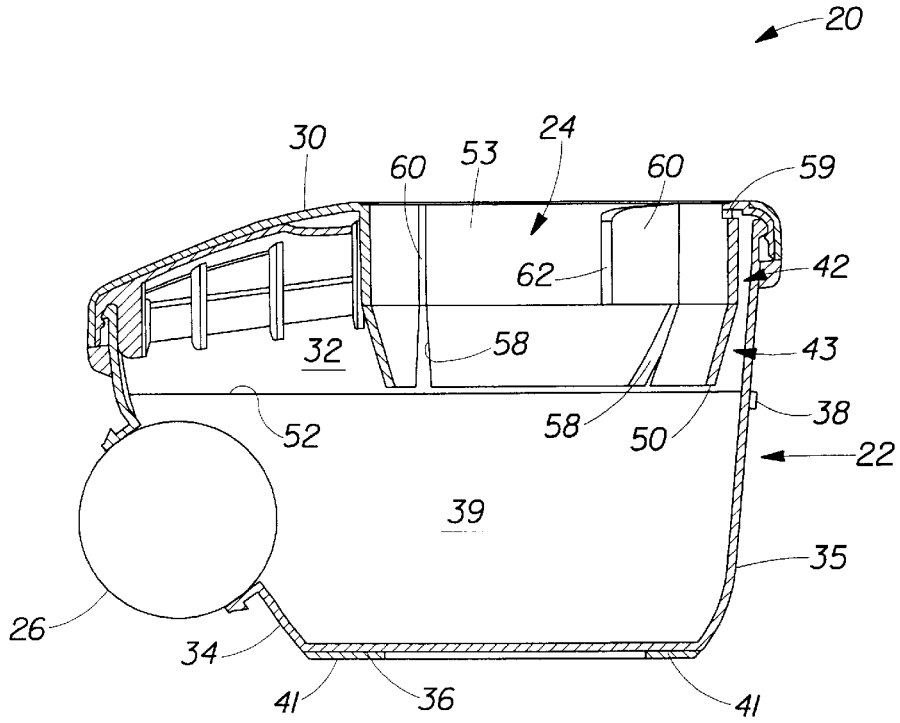
FIG. 4 is a cross sectional side view of the dosing and dispensing device of FIG. 3, wherein the device is filled with a liquid.
Figure 5:
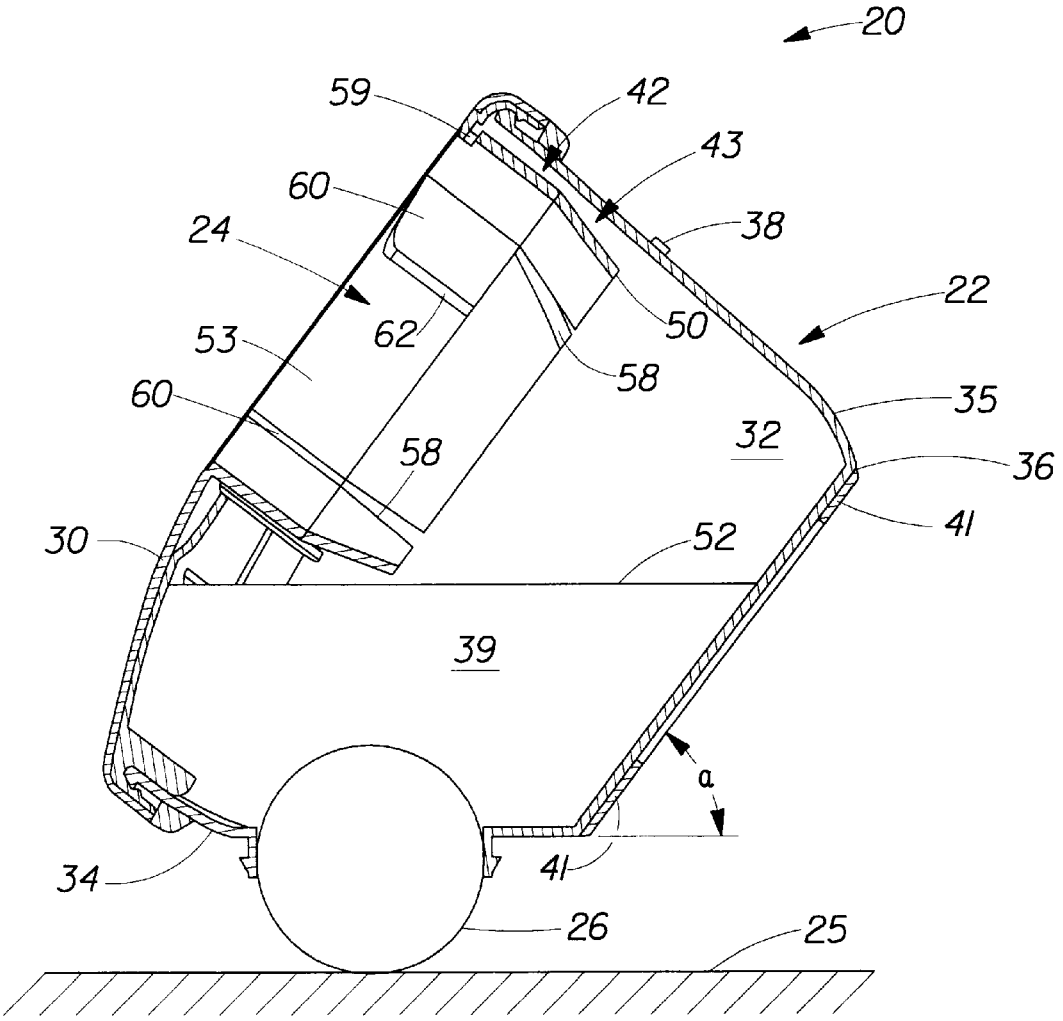
FIG. 5 is a cross sectional side view of the dosing and dispensing device of FIG. 4, wherein the device is tilted for pretreatment of a fabric.

The inlet wall bottom portion 43 is attached to the inlet wall top portion 42 and further extends into the hollow container 22. The end surface 50 of the bottom portion 43 preferably terminates at about the upper fill line 38 of the container 22 so that the end surface 50 does not penetrate the top surface 52 of the liquid 39 when the device 22 is level, as best seen in FIG. 4. More preferably, the container 22 is shaped and sized so that the end surface 50 of the bottom portion 43 of the inlet 24 does not penetrate the top surface 52 of the pretreatment liquid when the device 20 is tilted during use, as shown in FIG. 5. The degree of tilt ac during use is generally the complimentary angle to the angle $\beta$ (FIG. 3) between the front wall 34 and the bottom wall 36 such that the sum of the angles $\alpha$ and $\beta$ is 180 degrees. If the end surface 50 does penetrate the top surface 52 of the pretreatment liquid 39 when the device 20 is level and/or when it is tilted, some of the pretreatment liquid 39 is more likely to flow or splash onto the inner surface 53 of the inlet wall of the inlet 24 and exit the inlet during pretreatment. The angle $\beta$ is preferably between about 110 degrees and about 160 degrees. An angle $\beta$ in this range provides a device 20 which can be easily manipulated by a user of the device with respect to the fabric 25 during the pretreament process while still providing a device 20 which is substantially mess free.

Figure 6:
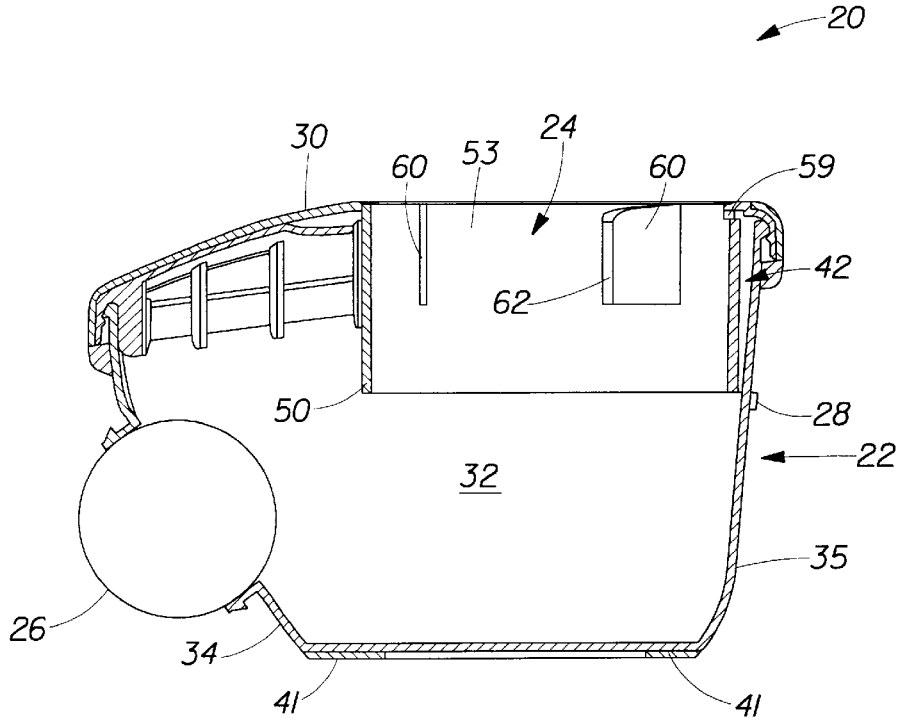
FIG. 6 is a cross sectional side view of another preferred dosing and dispensing device made in accordance with the present invention, wherein the upper and lower portions of the inlet are cylindrical in shape.
Figure 7:
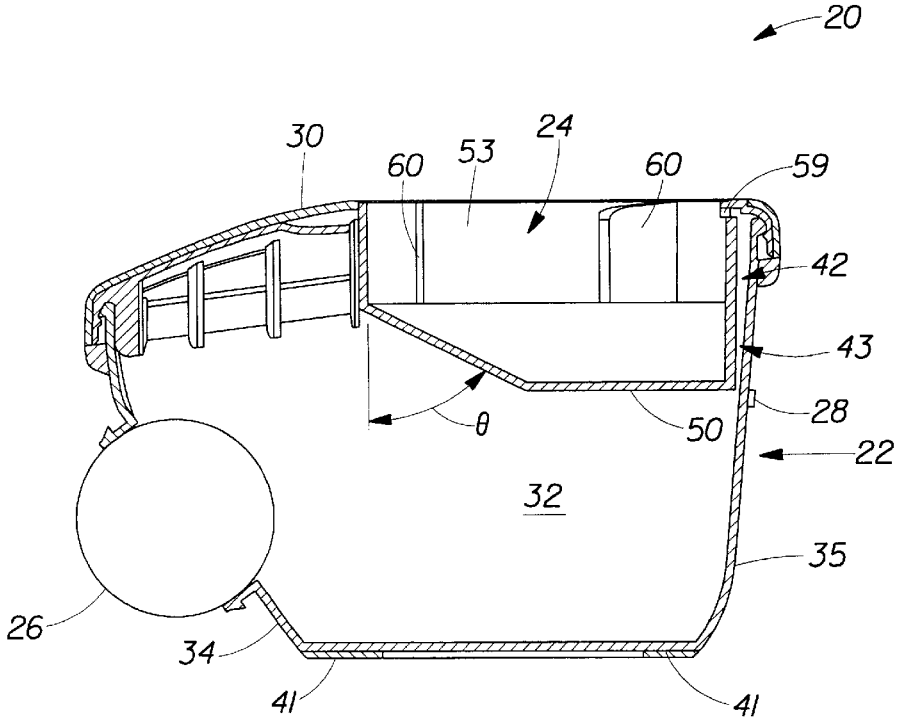
FIG. 7 is a cross sectional side of yet another preferred dosing and dispensing device made in accordance with the present invention, wherein a portion of the lower portion of the inlet is angled.
Figure 8:
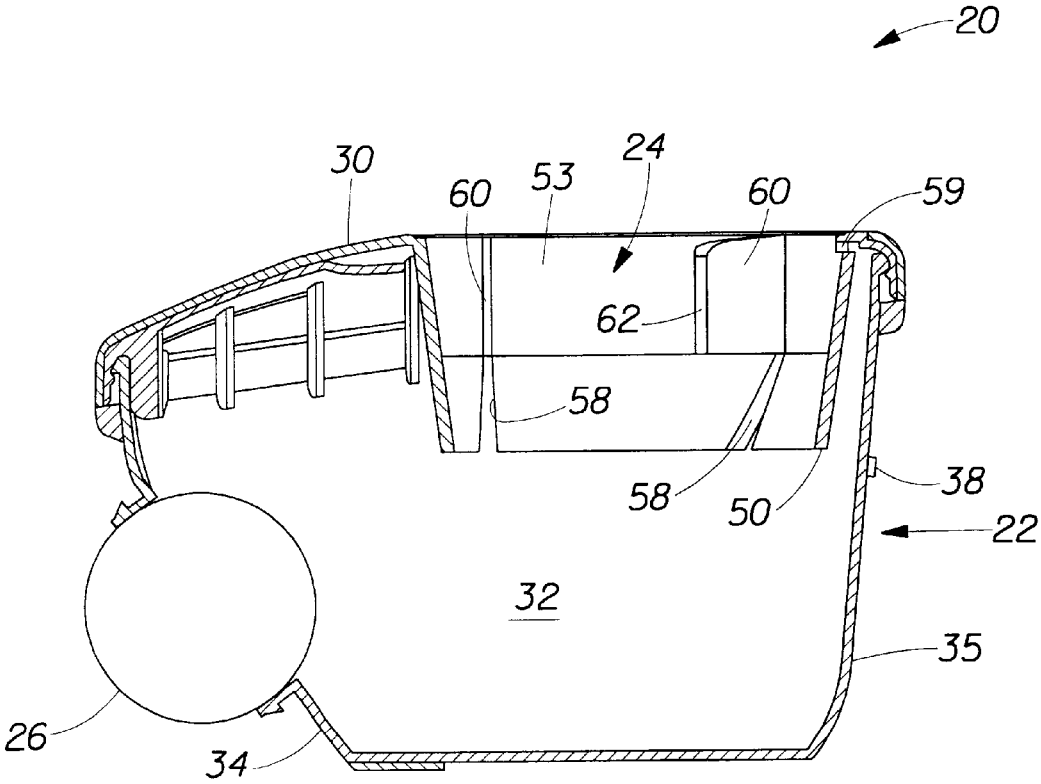
FIG. 8 is a cross sectional side of still yet another preferred dosing and dispensing device made in accordance with the present invention, wherein the upper and lower portions of the inlet are frustoconical in shape.

The bottom portion 43 is provided in the shape of a frustrum, and, more preferably, is frustoconical in shape. Most preferably, the bottom portion 43 forms an angle $\theta$ (FIG. 3) with the inner surface 53 of the inlet wall of the inlet 24 of between about 0 degrees and about 45 degrees. It has been found that the frustoconical shape of the bottom portion 43 can assist in preventing discharge or splashing of the pretreatment liquid 39 from the inlet 24 when the device is manipulated during the pretreatment of fabrics. While the frustoconical shape of the bottom portion 43 is preferred, other shaped and sized bottom portions (as well as top portions) can be implemented. For example, both the upper and lower portions can be cylindrical in shape, as shown in FIG. 6. Alternatively, the angle θ can be increased and/or a portion of bottom portion 43 can be provided as cylindrical in shape (i.e., without an angle θ), as shown in FIG. 7. Still further, the upper and lower portions can both be provided as frustoconical in shape, as shown in FIG. 8. Generally, however, the greater the depth D (FIG. 3) of the end surface 50 of the inlet wall of the inlet 24 below the top wall 30, the greater the reduction in the messiness of the device 20. Preferably, the depth D is between about 20% and about 50% of the height H of the device 20, and, more preferably, the depth D is between about 30% and about 40% of the height H of the device 20. Placement of the inlet 24 adjacent the rear wall 35 and/or inclusion of a downwardly depending wall permits the use of an inlet 24 having a large diameter opening for attachment to bottles of varying neck sizes as well as for ease of dispensing the liquid into the device 20 while preventing the messiness (e.g., undesirable discharge of the liquid from the device 20) which would otherwise be associated with a large diameter opening. The inlet 24 of the device 20 can be provided with an opening having a diameter D (FIG. 2) which is between about 50% and about 100% of the width W of the container 22, and, more preferably, the diameter D is between about 70% and about 90% of the width W of the container 22.

Figure 9:
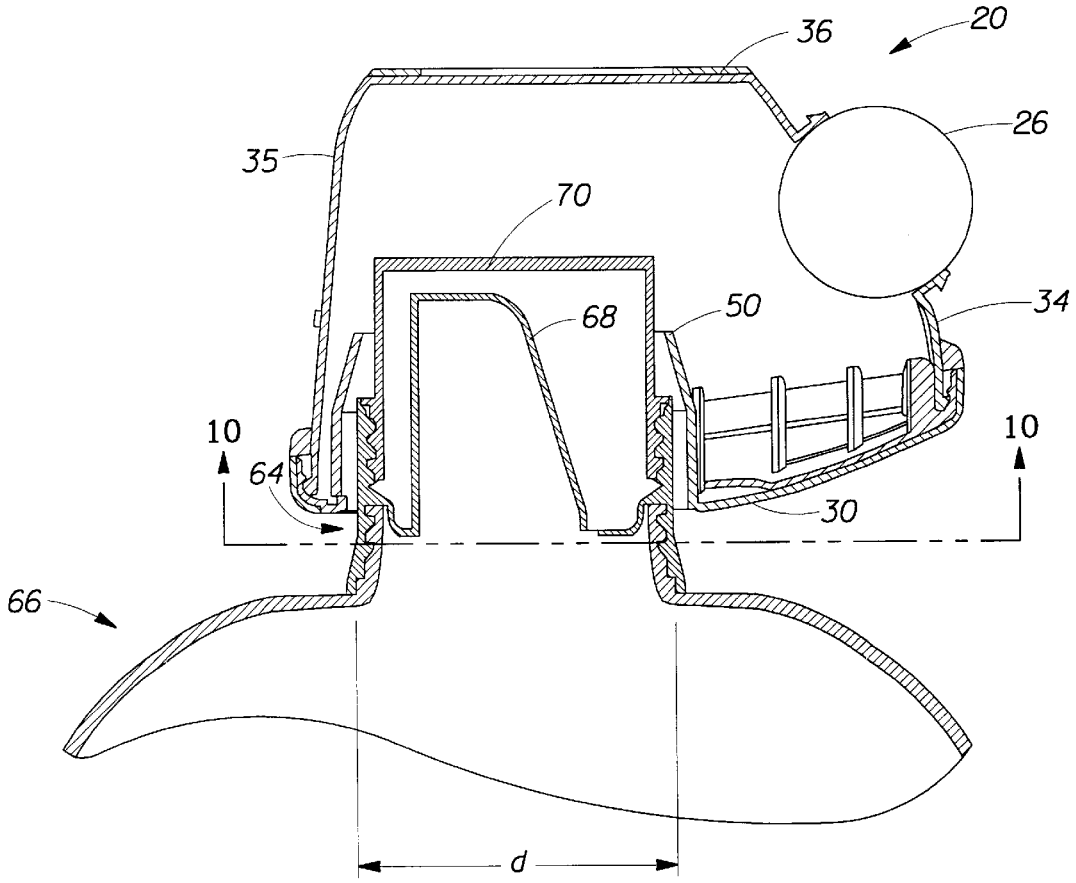
FIG. 9 is a partial cross sectional side view of the dosing and dispensing device of FIG. 3 attached to an exemplary bottle.
Figure 10:
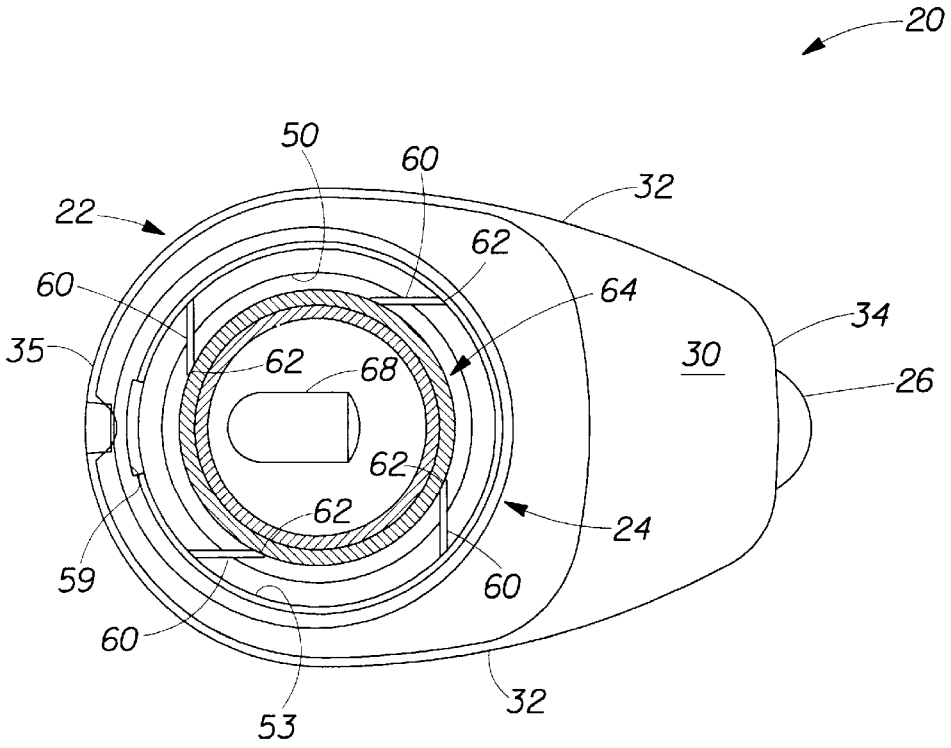
FIG. 10 is a cross sectional end view of the dosing and dispensing device and bottle of FIG. 8, taken along line 10—10 thereof.

The inlet 24 preferably includes a plurality of slots 58 which extend upwardly from the end surface 50 of the bottom portion 43 of the inlet 24 and which terminate before the top wall 30. The slots 58 provide a drain for any pretreatment liquid which might splash onto the inner surface 53 of inlet wall of the inlet 24. Still further, due to the depth D of the inlet 24 into hollow container 22, slots 58 are useful for draining water (and any other liquid) from the device 20 when it is held upside down. The device 20 might be placed in such an inverted orientation after completion of the wash cycle and removal from the washing machine in order to drain the device prior to storing it in an inverted manner on a bottle, as shown in FIG. 9. Still further, the slots 58 can assist in discharging the pretreatment liquid through the opening of the inlet 24 when the device 20 is spinning about a washing machine during the wash cycle. While the termination point of the slots 58 is shown as aligned with a plurality of tabs 60 (as best seen in FIG. 3), it will be appreciated that the slots 58 can be offset from the tabs 60 and a greater or lesser number of slots 58 can be provided, although it is preferable that about four equispaced slots are disposed about the bottom portion 43 of the inlet 24. In addition, a slit 59 is provided in the inner surface 53 of the upper portion 42 of the inlet 24 and adjacent the top wall 30. The slit 59 passes through the wall of the upper portion 42 of the inlet 24 so that it communicates with the interior of the hollow container 22. The slit 59 also assists in draining any liquids (e.g., wash water, pretreatment liquid, etc.) from the device 20 when the device 20 is placed in an inverted position. As will be appreciated, more than one slit 59 can be provided adjacent the top wall 30 to assist in liquid drainage.

In accordance with another aspect of the present invention and as best seen in FIGS. 2 and 3, the inlet 24 has a plurality of flexible and resilient tabs 60 disposed about the inner surface 53 of upper portion 42 of the inlet 24. The tabs 60 extend generally radially inward toward the center of the inlet 24. More preferably, the tabs 60 are provided in the form of cantilevered polyhedrals having a slanted end surface 62. The tabs 60 form an angle e (FIG. 2) of between about 20 degrees and about 70 degrees with the inner surface 53 of the inlet 24, and have a depth L of between about 6 mm and about 15 mm from the inner surface 53 to the slanted end surface 62. As best seen in FIG. 9, the tabs 60 slidably engage a neck 64 of a bottle 66. In addition, the tabs 60 flex toward the inner surface 53 of the inlet 24 about the tab's cantilever point at the inner surface 53. The force imparted by the flexure of the tabs 60 retains the device 20 with the bottle 66 for convenient storage. The bottle 66 preferably includes a spout 68 through which liquid stored in the bottle 66 can be dispensed and a threaded cap 70 which covers the spout 68 when the bottle 66 is not in use. As will be appreciated, the relatively large opening of the inlet in combination with the flexible tabs 60 provides a device 20 which can be attached to bottles 66 having neck diameters d of varying size. While the portion of the neck 64 which the tabs 60 engage to secure the device 20 the bottle 66 is substantially cylindrical in shape, the neck 64 can be provided in other shapes which can accommodate the tabs 60. The length of the cylindrical section of the neck 64 which engages the tabs 60 is preferably at least equal to the height h (FIG. 3) of the tabs 60. The angle ω and depth L of the tabs 60 determines the amount deflection which the tabs 60 will experience when engaging the neck 64 of the bottle 66. The amount of deflection, in turn, determines the amount of force which will be exerted between the tabs 60 and the neck 64 of the bottle 66 for keeping the device 20 attached to the bottle 66. As will be appreciated, the tabs 60 can undergo sufficient deflection to provide a force which accommodate necks 64 having a variety of diametrical dimensions such that the same device 20 can be attached to bottles 20 of varying sizes. While the tabs 60 are illustrated as having about the same length L, the length L of the tabs 60 can vary from tab to tab especially where the opening of the inlet 24 is not cylindrical in shape.

While the device 20 is illustrated as engaging the neck 64 of a bottle 66, it is contemplated that the device 20 can engage other portions of the bottle 20 for storage if desired. For instance, the device 20 might engage a protuberance disposed on the body of the bottle 66 (e.g., a protuberance disposed adjacent a handle of the bottle). As shown, the inlet 24 is configured so that the neck 64 and/or the cap 70 of the bottle 66 can pass through the opening of the inlet 24 in the top wall 30 and can preferably pass through the opening of the inlet 24 which is defined by the bottom edge 50 of the inlet wall.

The foregoing description of the preferred embodiments of the invention have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto.

What is claimed is:

1. A hand held dosing and dispensing device comprising:

a) a hollow container for storing a liquid having at least one container wall, said container having an inlet comprising an opening and an inlet wall which extends into said hollow container from said at least one container wall, said inlet wall substantially encircling said opening to prevent liquid discharge from said inlet during pretreatment of a fabric, wherein said opening further comprises a plurality of flexible and resilient tabs extending radially toward the center of said opening for engaging at least a portion of a bottle to secure the device to the bottle; and b) a discharge structure for the pretreatment of fabrics which is in fluid communication with said hollow container for dispensing the liquid therethrough, wherein said discharge structure is adapted to contact said fabrics for pretreatment.

2. The dosing and dispensing device of claim 1, wherein said discharge structure is a roller ball.

3. The dosing and dispensing device of claim 1, wherein said tabs form an angle of between about 20 degrees and about 70 degrees with the inner surface of said inlet wall.

4. The dosing and dispensing device of claim 1, wherein said tabs are adapted to engage any one of a plurality of generally cylindrical bottle necks of varying diametrical size.

5. The dosing and dispensing device of claim 1, wherein said inlet wall is generally cylindrical in shape.

6. The dosing device of claim 1, wherein said inlet wall is generally frustoconical in shape.

7. The dosing and dispensing device of claim 1, wherein said inlet wall comprises an upper portion and a lower portion, wherein said upper portion is generally cylindrical in shape and said lower portion is generally frustoconical in shape.

8. The dosing and dispensing device of claim 1, wherein said inlet further comprises a plurality of slots disposed in said inlet wall, said slots extending upwardly from the bottom edge of said inlet wall.

9. The dosing and dispensing device of claim 1, wherein the device is formed by bi-injection molding and wherein said hollow container is formed from a first rigid structural material and wherein the device further comprises a soft grip surface disposed about at least a portion of the exterior of said hollow container and wherein said grip surface is formed from a second material.

10. The dosing and dispensing device of claim 1, wherein said container further comprises a front wall, a rear wall opposite said front wall, bottom wall, a top wall opposite said bottom wall, and side walls interconnected with said top wall, said bottom wall, said front wall, and said rear wall and wherein said inlet is disposed in said top wall and said roller ball is disposed in said front wall.

11. The dosing device of claim 10, wherein said front wall and said bottom wall form an angle therebetween, and wherein said angle is between about 110 degrees and about 160 degrees.

12. The dosing device of claim 10, wherein said inlet is disposed adjacent said rear wall.

13. The dosing device of claim 1, wherein said inlet wall has a depth between about 20% and about 50% of the height of the dosing device.

14. The dosing device of claim 1, wherein the diameter of said inlet is between about 50% and about 100% of the width of said container.

15. The dosing device of claim 1, wherein said inlet wall further comprises at least one slit there through, wherein said slit is disposed adjacent said opening.

16. A liquid treating system for fabrics comprising:

a) a bottle for storing a liquid detergent; and b) a dosing and dispensing device releasably attached to said bottle, said dosing and dispensing device comprising a hollow container for storing the liquid having at least one container wall, said container having an inlet comprising an opening and an inlet wall which extends into said hollow container from said at least one container wall, said inlet wall substantially encircling said opening to prevent liquid discharge from said inlet during pretreatment of a fabric, wherein said opening further comprises a plurality of flexible and resilient tabs extending radially toward the center of said opening for engaging at least a portion of said bottle to secure the device to the bottle, and a discharge structure for the pretreatment of fabrics which is in fluid communication with said hollow container for dispensing the liquid therethrough, wherein said discharge structure is adapted to contact said fabrics for pretreatment.

17. The liquid treating system of claim 10, wherein said tabs form an angle of between about 20 degrees and about 70 degrees with the inner surface of said inlet wall.

18. The liquid treating system of claim 10, said bottle further comprises a generally cylindrical neck having a spout and wherein said dosing and dispensing device engages said neck.

19. The liquid treating system of claim 18, wherein said tabs are adapted to engage any one of a plurality of generally cylindrical bottle necks of varying diametrical size.

20. The liquid treating system of claim 16, wherein said inlet wall is generally cylindrical in shape.

21. The liquid treating system of claim 16, wherein said inlet wall is generally frustoconical in shape.

22. The liquid treating system of claim 16, wherein said inlet wall comprises an upper portion and a lower portion, wherein said upper portion is generally cylindrical in shape and said lower portion is generally frustoconical in shape.

23. The liquid treating system of claim 16, wherein said inlet further comprises a plurality of slots disposed in said inlet wall, said slots extending from the bottom edge of said inlet wall.

24. The liquid treating system of claim 16, wherein dosing and dispensing device is formed by bi-injection molding and wherein said hollow container is formed from a first rigid structural material and wherein the device further comprises a soft grip surface disposed about at least a portion of the exterior of said hollow container, wherein said grip surface is formed from a second material.

25. The liquid treating system of claim 16, wherein said inlet wall extends into said hollow container at least about 20% of the height of said container.

* * * * *